US010679575B2

(12) United States Patent
Kang

(10) Patent No.: US 10,679,575 B2
(45) Date of Patent: Jun. 9, 2020

(54) DRIVE METHOD AND APPARATUS OF DISPLAY APPARATUS, AND DISPLAY APPARATUS

(71) Applicants: HKC Corporation Limited, Shuitian Village, Shiyan Sub-district (CN); Chongqing HKC Optoelectronics Technology Co., Ltd., Chongqing (CN)

(72) Inventor: Chih-Tsung Kang, Chongqing (CN)

(73) Assignees: HKC Corporation Limited, Shenzhen, Guangdong (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 50 days.

(21) Appl. No.: 16/064,600

(22) PCT Filed: Jan. 23, 2018

(86) PCT No.: PCT/CN2018/073763
§ 371 (c)(1),
(2) Date: Jun. 21, 2018

(87) PCT Pub. No.: WO2019/119603
PCT Pub. Date: Jun. 27, 2019

(65) Prior Publication Data

US 2019/0206342 A1 Jul. 4, 2019

(30) Foreign Application Priority Data

Dec. 21, 2017 (CN) ..... 2017 1 1394030

(51) Int. Cl.
*G09G 3/36* (2006.01)

(52) U.S. Cl.
CPC ... *G09G 3/3607* (2013.01); *G09G 2300/0452* (2013.01); *G09G 2320/0233* (2013.01);
(Continued)

(58) Field of Classification Search
CPC ..... G09G 3/3607; G09G 2300/0452; G09G 2320/0233; G09G 2320/0242;
(Continued)

(56) References Cited

U.S. PATENT DOCUMENTS 10,068,536 B2 * 9/2018 Miura ..... G09G 3/3685
10,068,540 B2 * 9/2018 Park ..... G09G 3/3648
(Continued)

FOREIGN PATENT DOCUMENTS

CN 101329846 A 12/2008
CN 102262868 A 11/2011
(Continued)

OTHER PUBLICATIONS

International Search Report and Written Opinion dated Sep. 13, 2018, in International Application No. PCT/CN2018/073763.

*Primary Examiner* — Sejoon Ahn
(74) *Attorney, Agent, or Firm* — Muncy, Geissler, Olds & Lowe, P.C.

(57) ABSTRACT

This application provides a drive method, includes: calculating average signals of subpixel units in a zone, to obtain a first average signal of the zone, a second average signal of the zone, and a third average signal of the zone; and separately performing first and third gamma adjustments according to a predefined range corresponding to grayscales of the first, the second, the third average signals. In this way, luminance ratios of first and third hues in a large viewing angle to a second hue in a large viewing angle, thereby improving brightness of the second hue in a large viewing angle. In addition, by means of compensation for first and third light source luminance signals, a color viewed in a front viewing angle can be maintained the same as an original color, and performance of the original color is not affected by adjustment of first and third gamma signals.

6 Claims, 7 Drawing Sheets

(52) U.S. Cl.
CPC ..... *G09G 2320/0242* (2013.01); *G09G 2320/0276* (2013.01); *G09G 2320/0626* (2013.01); *G09G 2320/0673* (2013.01); *G09G 2360/16* (2013.01)

(58) Field of Classification Search
CPC ... G09G 2320/0276; G09G 2320/0626; G09G 2320/0673; G09G 2360/16
See application file for complete search history.

(56) References Cited

U.S. PATENT DOCUMENTS

| | | | | |
|---|---|---|---|---|
| 10,068,541 | B2 * | 9/2018 | Sakaigawa ..... | G09G 3/3607 |
| 2005/0200580 | A1 * | 9/2005 | Li ..... | G09G 3/3607 345/88 |
| 2017/0110064 | A1 * | 4/2017 | Zhang ..... | G09G 3/2018 |

FOREIGN PATENT DOCUMENTS

| | | | |
|---|---|---|---|
| CN | 104299568 | A | 1/2015 |
| CN | 105096890 | A | 11/2015 |
| CN | 107967899 | A | 4/2018 |

* cited by examiner

DRIVE METHOD AND APPARATUS OF DISPLAY APPARATUS, AND DISPLAY APPARATUS

BACKGROUND

Technical Field

This application relates to the display field, and in particular, to a drive method and apparatus of a display apparatus, and a display apparatus.

Related Art

A liquid-crystal display (LCD) is a flat thin display apparatus, includes a number of color or black and white pixels, and is disposed in front of a light source or a reflecting surface. Each pixel includes the following parts: a liquid crystal molecular layer suspending between two transparent electrodes, and two polarization filters, with polarization directions perpendicular to each other, disposed on two outer sides. If there is no liquid crystal between the electrodes, when light passes through one of the polarization filters, a polarization direction of the light is completely perpendicular to the second polarization filter, and therefore the light is completely blocked. However, if the polarization direction of the light passing through one of the polarization filters is rotated by liquid crystals, the light can pass through the other polarization filter. Rotation of the polarization direction of the light by the liquid crystals may be controlled by means of an electrostatic field, so as to implement control on the light.

Before charges are applied to the transparent electrodes, arrangement of liquid crystal molecules is determined by arrangement on surfaces of the electrodes. Surfaces of chemical substances on the electrodes may be used as seed crystals of crystals. In most common twisted nematic (TN) liquid crystals, two electrodes above and below liquid crystals are vertically arranged. Liquid crystal molecules are arranged in a spiral manner. A polarization direction of light passing through one of polarization filters rotates after the light passes through a liquid crystal sheet, so that the light can pass through the other polarization filter. In this process, a small part of light is blocked by the polarization filter, and looks gray when being seen from outside. After the charges are applied to the transparent electrodes, the liquid crystal molecules are arranged in a manner of being almost completely arranged in parallel along an electric field direction. Therefore, a polarization direction of light passing through one of polarization filters does not rotate, and therefore the light is completely blocked. In this case, a pixel looks black. A twisting degree of arrangement of the liquid crystal molecules can be controlled by means of voltage control, so as to achieve different grayscales.

Because liquid crystals do not have colors themselves, a color filter is used to generate various colors, and is a key component for turning grayscales into colors of an LCD. A backlight module in the LCD provides a light source, and then grayscale display is formed by means of a drive IC and liquid crystal control, and the light source passes through a color resist layer of the color filter to form a color display image.

SUMMARY

A color resist layer frequently used in a color filter of an LCD may use two models: a red, green, and blue (RGB) color model and a cyan, magenta, and yellow (CMY) color model.

Due to correlation between a refractive index and a wavelength, transmittance of different wavelengths is related to phase delays of different wavelengths, and transmittance has different performance according to different wavelengths. In addition, with drive of a voltage, phase delays of different wavelengths also generate changes of different degrees, affecting performance of transmittance of different wavelengths.

An objective of this application is to provide a drive method of a display apparatus, including the following steps:

calculating average signals of subpixel units in a zone, to obtain a first average signal of the zone, a second average signal of the zone, and a third average signal of the zone; separately performing first and third gamma adjustments according to a predefined range corresponding to grayscales of the first, the second, and the third average signals; and adjusting luminance of corresponding first and third light sources.

In an embodiment of this application, the grayscale of the second average signal of the zone is a first grayscale value in the predefined range; and when the grayscale of the first average signal of the zone and the grayscale of the third average signal of the zone are a second grayscale value in the predefined range, first and third gammas ($\gamma$) are adjusted from original $\gamma R$ and $\gamma B$ to $\gamma R1$ and $\gamma B1$, where $\gamma R1<\gamma R$ and $\gamma B1<\gamma B$; or when the grayscale of the first average signal of the zone and the grayscale of the third average signal of the zone are a third grayscale value in the predefined range, first and third gammas ($\gamma$) are adjusted from original $\gamma R$ and $\gamma B$ to $\gamma R2$ and $\gamma B2$, wherein $\gamma R2>\gamma R$ and $\gamma B2>\gamma B$.

In an embodiment, the first grayscale value and the second grayscale value in the predefined range are selected from the following groups:

a first group: when the first grayscale value is in a range of 255 to 200, the second grayscale value is in a range of 80 to 200, and the third grayscale value is in a range of 0 to 50;

a second group: when the first grayscale value is in a range of 200 to 150, the second grayscale value is in a range of 80 to 200, and the third grayscale value is in a range of 0 to 80;

a third group: when the first grayscale value is in a range of 150 to 100, the second grayscale value is in a range of 60 to 150, and the third grayscale value is in a range of 0 to 60;

a fourth group: when the first grayscale value is in a range of 100 to 50, the second grayscale value is in a range of 40 to 100, and the third grayscale value is in a range of 0 to 40; and a fifth group: when the first grayscale value is in a range of 50 to 0, the second grayscale value is in a range of 20 to 50, and the third grayscale value is in a range of 0 to 20.

In an embodiment, when the grayscale of the first average signal of the zone and the grayscale of the third average signal of the zone are the second grayscale value in the predefined range, the first and the third gammas are adjusted, so that luminance corresponding to the grayscales of the first and the third average signals increases, and luminance increase calculation formulas are:

$$L'R(g)=LR(255)*(g/255)^{\gamma R1}; \text{ and}$$

$$L'B(g)=LB(255)*(g/255)^{\gamma B1}; \text{ or}$$

when the grayscale of the first average signal of the zone and the grayscale of the third average signal of the zone are the third grayscale value in the predefined range, the first and the third gammas are adjusted, so that luminance corresponding to the grayscales of the first and the third average signals decreases, and luminance decrease calculation formulas are:

$$L''R(g)=LR(255)*(g/255)^{\gamma R2}; \text{ and}$$

$$L''B(g)=LB(255)*(g/255)^{\gamma B2}, \text{where grayscale grepresents any grayscale.}$$

In an embodiment, a calculation formula for the adjusting luminance corresponding to a first light source is:

$$A'n,m_R/An,m_R=LR(Ave_Rn,m)/L'R(Ave_Rn,m)=LR(255)*(Ave_Rn,m/255)^{\gamma R}/LR(255)*(Ave_Rn,m/255)^{\gamma R1}; \text{ and}$$

$$A''n,m_R/An,m_R=LR(Ave_Rn,m)/L''R(Ave_Rn,m)=LR(255)*(Ave_Rn,m/255)^{\gamma R}/LR(255)*(Ave_Rn,m/255)^{\gamma R2}; \text{ and}$$

a calculation formula for adjusting a luminance corresponding to a third light source is:

$$A'n,m_B/An,m_B=LB(Ave_Bn,m)/L'B(Ave_Bn,m)=LB(255)*(Ave_Bn,m/255)^{\gamma B}/LB(255)*(Ave_Bn,m/255)^{\gamma B1}; \text{ and}$$

$$A''n,m_B/An,m_B=LB(Ave_Bn,m)/L''B(Ave_Bn,m)=LB(255)*(Ave_Bn,m/255)^{\gamma B}/LB(255)*(Ave_Bn,m/255)^{\gamma B2}, \text{where}$$

A'n,m_R and A"n,m_R are an adjusted first light source luminance signal, An,m_R is an initial first light source luminance signal, and Ave_Rn,m is a calculated average signal of all first subpixel units in the zone; and A'n,m_B and A"n,m_B are an adjusted third light source luminance signal, An,m_B is an initial third light source luminance signal, Ave_Bn,m is a calculated average signal of all third subpixel units in the zone, and n and m are a column and a row in which the zone is located.

Another objective of this application is to provide a drive apparatus of a display apparatus, including at least one zone, where each zone includes a plurality of pixel units, and each pixel unit includes a first subpixel unit, a second subpixel unit, and a third subpixel unit, and including: calculating average signals of subpixel units in a zone, to obtain a first average signal of the zone, a second average signal of the zone, and a third average signal of the zone; separately performing first and third gamma adjustments according to a predefined range corresponding to grayscales of the first, the second, and the third average signals; and adjusting luminance of corresponding first and third light sources.

To resolve a color cast problem of red, green, and a third hue, another objective of this application is to provide a display apparatus, including a display pane and the drive apparatus of the display apparatus in the foregoing technical features. The drive apparatus transmits an image signal to the display panel.

A grayscale drive method for improving a color cast of a second hue in a large viewing angle is used. That is, average signals of subpixel units in a zone are calculated, to obtain a first average signal of the zone, a second average signal of the zone, and a third average signal of the zone; first and third gamma adjustments are separately performed according to a predefined range corresponding to grayscales of the first, the second, and the third average signals; and luminance of corresponding first and third light sources is separated adjusted. The first and the third input gamma signals are increased. In this way, luminance ratios of first and third large viewing angles to a second large viewing angle, thereby improving brightness of a second hue in a large viewing angle. In addition, by means of compensation for first and third light source luminance signals, a color viewed in a front angle can be maintained the same as an original color, and performance of the original color is not affected by adjustment of first and third gamma signals. Color brightness of the second hue in a large viewing angle can be improved while performance of an original color signal can be maintained.

DETAILED DESCRIPTION

The following embodiments are described with reference to the accompanying drawings, used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by a same reference number. In addition, for understanding and ease of description, the size and the thickness of each component shown in the accompanying drawings are randomly shown, but this application is not limited thereto.

In addition, throughout this specification, unless otherwise explicitly described to have an opposite meaning, the word "include" is understood as including the component, but not excluding any other component. In addition, in this specification, "on" means that a component is located on or below a target component, but does not mean that the component needs to be located on top of a gravity direction.

To further describe technical means used in this application to achieve a preset inventive objective and technical effects of this application, specific implementations, structures, features, and effects of a drive method and apparatus of a display apparatus, and a display apparatus that are provided according to this application are described in detail below with reference to the accompanying drawings and preferred embodiments.

In some embodiments, a first hue is a red hue, a second hue is a green hue, and a third hue is a blue hue. Correspondingly, first, second, and third grayscale signals are RGB grayscale signals, and a first average signal of a zone, a second average signal of a zone, and a third average signal of a zone are a red average signal, a green average signal, and a blue average signal. Other descriptions about "first", "second", and "third" in the embodiments are similar.

Figure 1:
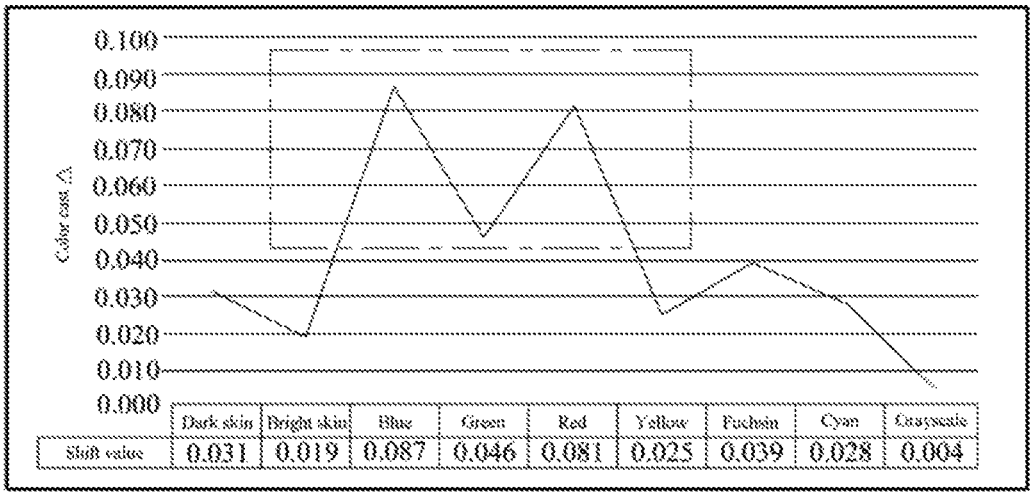
FIG. 1 is a diagram of a relationship between a color system and a color cast of an LCD before pixel adjustment according to an embodiment of this application.

Referring to FIG. 1, FIG. 1 is a diagram of a relationship between a color system and a color cast of an LCD before pixel adjustment. Changes in color casts of various representative color systems of an LCD in a large viewing angle and a front viewing angle may be learned. It can be obviously found that color casts of color systems using an RGB color model in a large viewing angle are more severe than those of other color systems. Therefore, reducing color cast defects of the first, the second, and the third hues can greatly reduce an overall color cast in a large viewing angle.

Figure 2:
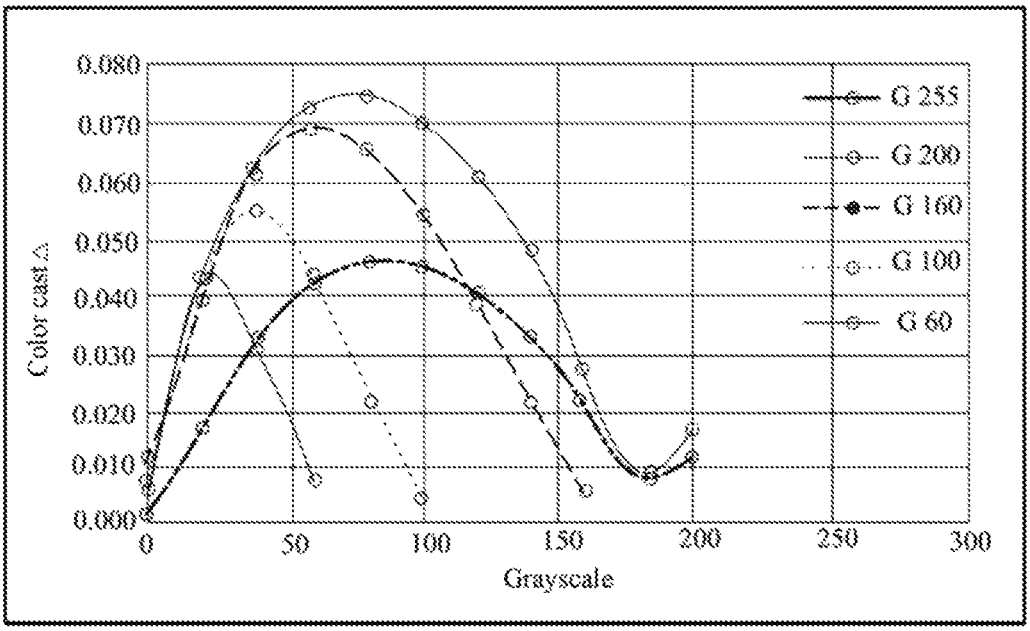
FIG. 2 is a diagram of a relationship between a second color cast and a grayscale of an LCD before pixel adjustment according to an embodiment of this application.
Figure 7:
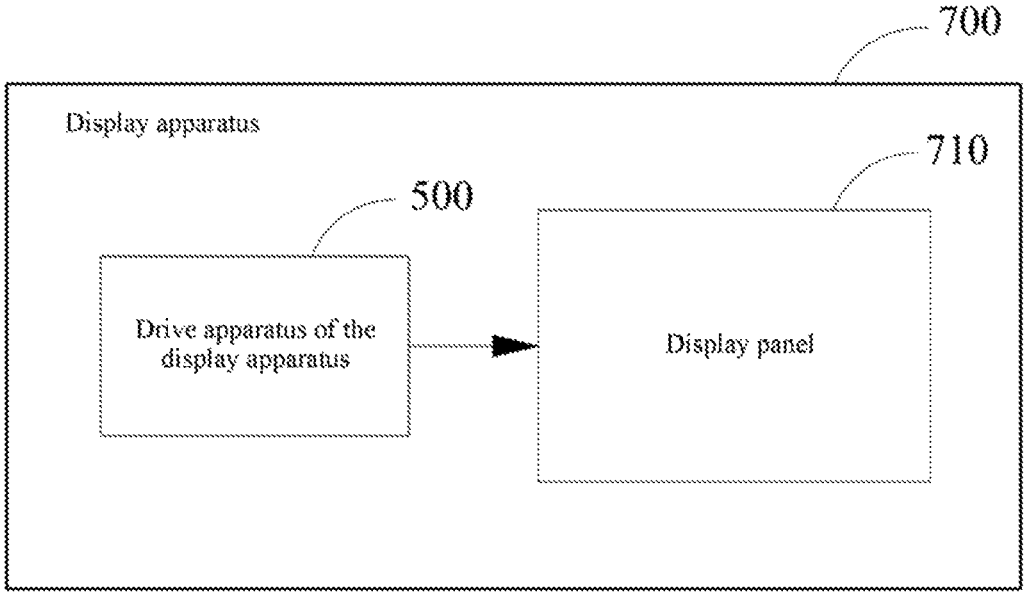
FIG. 7 is a functional structure diagram of a display apparatus that applies a drive apparatus of a display apparatus according to an embodiment of this application.

FIG. 2 is a diagram of a relationship between a second color cast and a grayscale of an LCD before pixel adjustment according to an embodiment of this application. FIG. 7 is a functional structure diagram of a display apparatus that applies a drive apparatus of the display apparatus according to an embodiment of this application. Referring to both FIG. 2 and FIG. 7, the display apparatus 700 includes a drive apparatus 500 of the display apparatus that transmits an image signal to a display panel 710. As shown in FIG. 2, FIG. 2 shows color difference changes under different color mixing conditions of a second color system in a front viewing angle and a horizontal viewing angle of 60 degrees. When a second (Green; G) grayscale is 255, first (Red; R) and third (Blue; B) grayscales are in a range of 20 to 180. Weaker first and third grayscale signals indicate a severer color cast of the second hue.

When the second grayscale is 200, first and third grayscales are in a range of 10 to 180. Weaker first and third grayscale signals indicate a severer color cast of the second hue.

When the second grayscale is 160, first and third grayscales are in a range of 10 to 140. Weaker first and third grayscale signals indicate a severer color cast of the second hue.

When the second grayscale is 100, first and third grayscales are in a range of 10 to 80. Weaker first and third grayscale signals indicate a severer color cast of the second hue.

Figure 3:
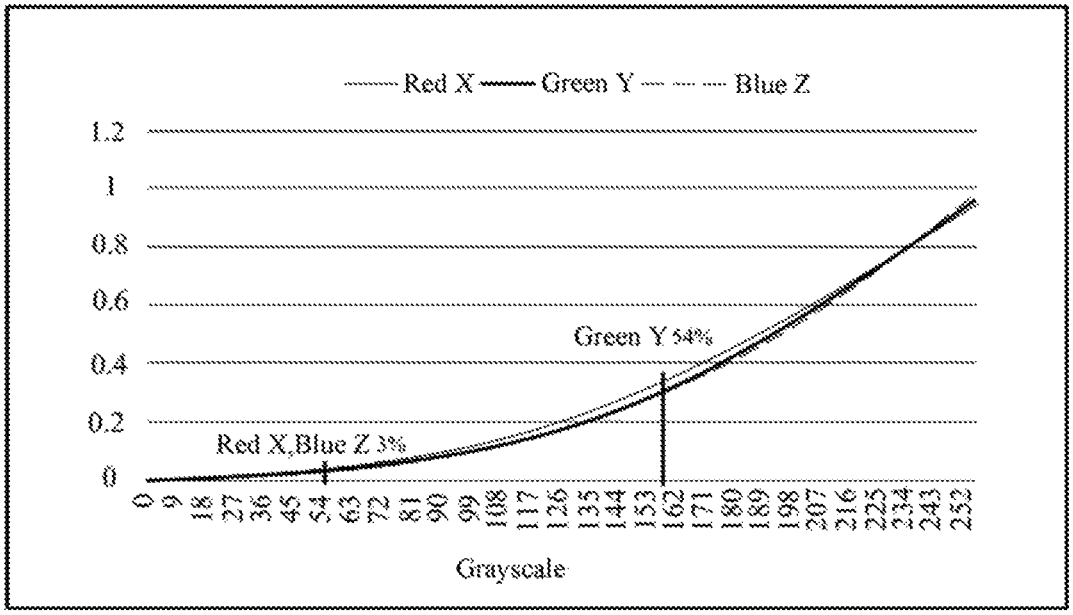
FIG. 3 is a diagram of a relationship between red X, green Y, and blue Z of R, G, and B in a front viewing angle and a grayscale of an LCD before pixel adjustment according to an embodiment of this application.
Figure 4:
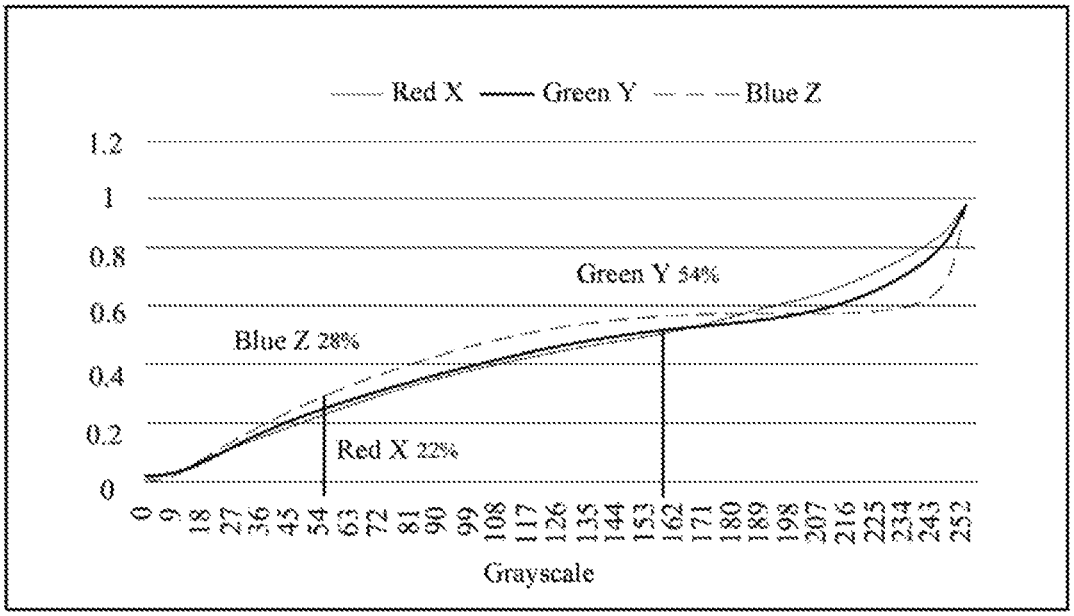
FIG. 4 is a diagram of a relationship between red X, green Y, and blue Z of R, G, and B in a large viewing angle and a grayscale of an LCD before pixel adjustment according to an embodiment of this application.

Refer to FIG. 3, FIG. 4, and the following descriptions for a reason of a color cast. FIG. 3 is a diagram of a relationship between red X, green Y, and blue Z of R, G, and B in a front viewing angle and a grayscale of an LCD before pixel adjustment according to an embodiment of this application. FIG. 4 is a diagram of a relationship between red X, green Y, and blue Z of R, G, and B in a large viewing angle and a grayscale of an LCD before pixel adjustment according to an embodiment of this application.

For example, when a grayscale of a mixed color in a front viewing angle includes R=50, G=160, and B=50, ratios of grayscales of red X, green Y, and blue Z in the front viewing angle to a full grayscale R=255, G=255, and B=255 are 3%, 36%, and 3% in color mixing.

Ratios of grayscales of red X, green Y, and blue Z in a large viewing angle to the full grayscale R=255, G=255, and B=255 are 22%, 54%, and 28% in color mixing. Different ratios of red X, green Y, and blue Z in the front viewing angle and the large viewing angle in color mixing cause that in the front viewing angle, the ratios of red X and blue Z are quite smaller than luminance of green X, and that in the large viewing angle, the ratios of red X and blue Z cannot be ignored in relative to luminance of green X. Consequently, a color cast of the second hue in the large viewing angle is less obvious than that in the front viewing angle.

Figure 5:
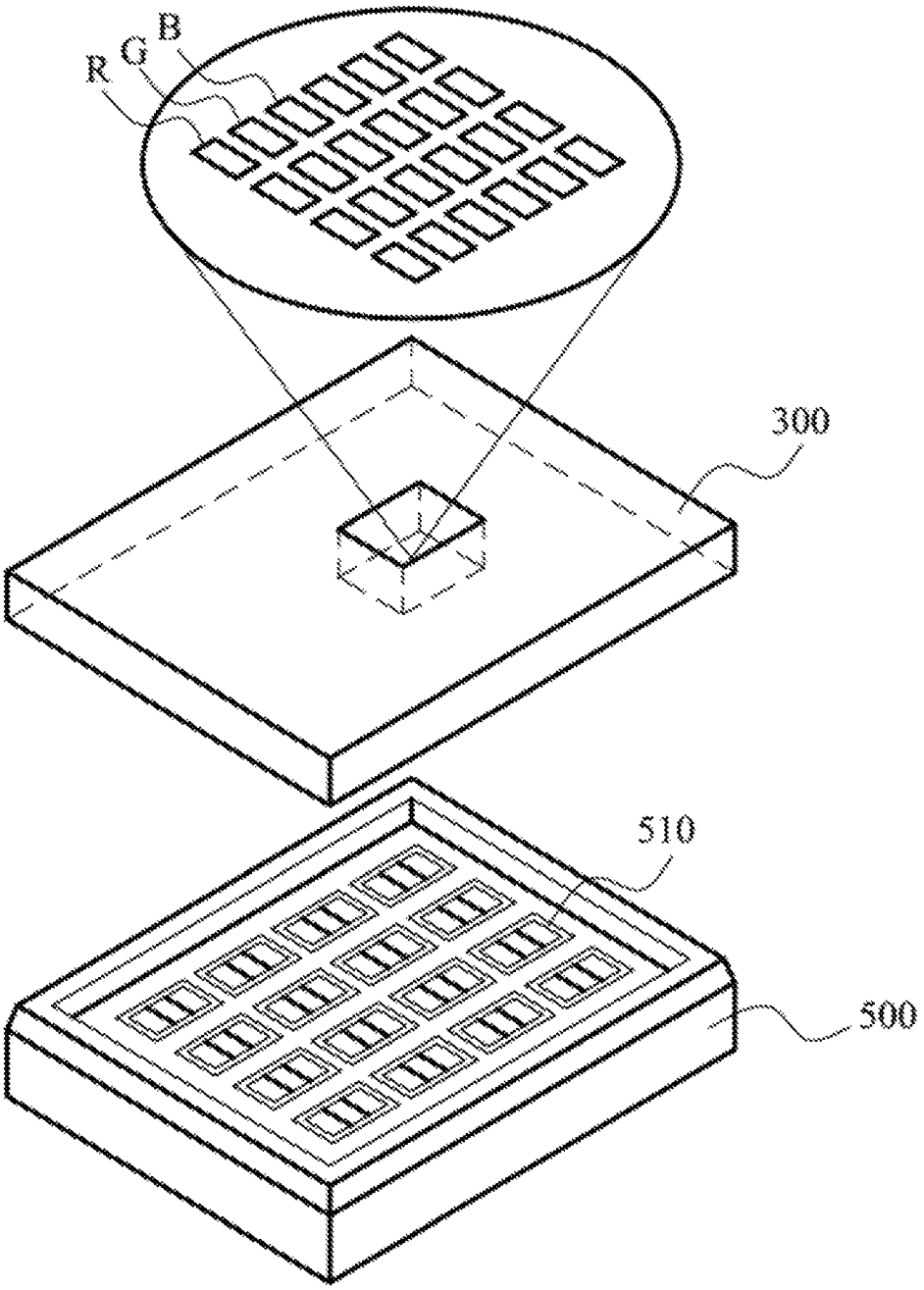
FIG. 5 is a schematic diagram of a drive apparatus of a display apparatus according to an embodiment of this application.

FIG. 5 is a schematic diagram of a drive apparatus of a display apparatus according to an embodiment of this application. The drive apparatus of the display apparatus includes a plurality of first subpixels, second subpixels, and third subpixels. That is, the drive apparatus includes red subpixels, green subpixels, and blue subpixels. Each group of a red subpixel, a green subpixel, and a blue subpixel is referred to as a pixel unit, and each pixel unit represents an image signal. The LCD in this application is divided into a plurality of zones, and each zone includes a plurality of pixel units. The size of the zone may be self-defined. The LCD may be divided into a plurality of column by row (N*M) zones formed by pixel units.

The drive apparatus in this application calculates average signals of subpixel units in a zone, to obtain a first average signal of the zone, a second average signal of the zone, and a third average signal of the zone; then separately adjusts first and third gamma signals according to a predefined range corresponding to grayscales of the first, the second, and the third average signals; and adjusts luminance of first and third LED light sources in each zone, so as to maintain correctness of a color viewed in a front viewing angle and reduces defects of viewing angle color casts. The first and the third gamma signals are red and blue gamma signals.

Figure 6:
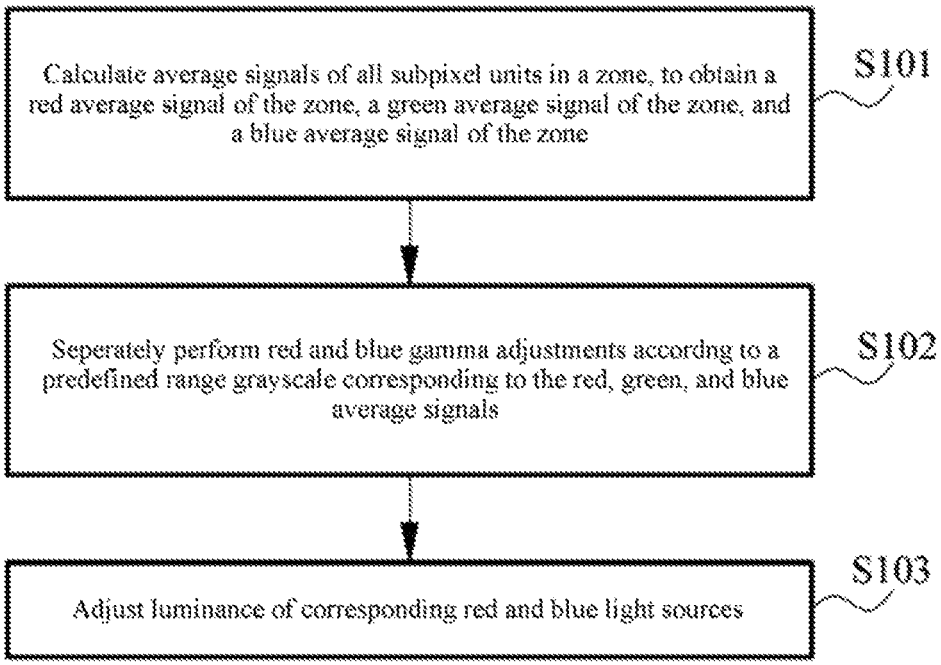
FIG. 6 is a flowchart of a drive method of a display apparatus according to an embodiment of this application.

FIG. 6 is a flowchart of a drive method of a display apparatus according to an embodiment of this application. For details, refer to the following descriptions.

Step S101: Calculate average signals of subpixel units (Rn,m_i,j, Gn,m_i,j, and Bn,m_i,j) in a zone (n,m) to obtain a first average signal (Ave_Rn,m) of the zone, a second average signal (Ave_Gn,m) of the zone, and a third average signal (Ave_Bn,m) of the zone, where i and j are pixel units in the zone (n,m). Step S102: Separately perform first and third gamma adjustments according to a predefined range corresponding to grayscales of the first, the second, and the third average signals. Step S103: Adjust luminance of corresponding first and third light sources.

For example, if the grayscale of the second average signal of the zone is in a range of 255 to 200 in the predefined range, when the grayscale of the first average signal of the zone and the grayscale of the third average signal of the zone are in a range of 80 to 200 in the predefined range, first and third gammas (γ) are adjusted from original γR and γB to γR1 and γB1, where γR1<γR and γB1<γB; or when the grayscale of the first average signal of the zone and the grayscale of the third average signal of the zone are in a range of 0 to 50 in the predefined range, first and third gammas (γ) are adjusted from original γR and γB to γR2 and γB2, where γR2>γR and γB2>γB.

In another embodiment of this application, the predefined range corresponding to the grayscales of the first, the second, and the third average signals in step S102 is: if the grayscale of the second average signal of the zone is in a range of 200 to 150 in the predefined range, and when the grayscale of the first average signal of the zone and the grayscale of the third average signal of the zone are in a range of 80 to 200 in the predefined range, first and third gammas are adjusted from original γR and γB to γR1 and γB1, where γR1<γR and γB1<γB; or when the grayscale of the first average signal of the zone and the grayscale of the third average signal of the zone are in a range of 0 to 80 in the predefined range, first and third gammas are adjusted from original γR and γB to γR2 and γB2, where γR2>γR and γB2>γB.

In another embodiment of this application, the predefined range corresponding to the grayscales of the first, the second, and the third average signals in step S102 is: when the grayscale of the second average signal of the zone is in a range of 150 to 100 in the predefined range, and when the grayscale of the first average signal of the zone and the grayscale of the third average signal of the zone are in a range of 60 to 150 in the predefined range, first and third gammas are adjusted from original γR and γB to γR1 and γB1, where γR1<γR and γB1<γB; or when the grayscale of the first average signal of the zone and the grayscale of the third average signal of the zone are in a range of 0 to 60 in the predefined range, first and third gammas are adjusted from original γR and γB to γR2 and γB2, where γR2>γR and γB2>γB.

In another embodiment of this application, the predefined range corresponding to the grayscales of the first, the second, and the third average signals in step S102 is: when the grayscale of the second average signal of the zone is in a range of 100 to 50 in the predefined range, and when the grayscale of the first average signal of the zone and the grayscale of the third average signal of the zone are in a range of 40 to 100 in the predefined range, first and third gammas are adjusted from original γR and γB to γR1 and γB1, where γR1<γR and γB1<γB; or when the grayscale of the first average signal of the zone and the grayscale of the third average signal of the zone are in a range of 0 to 40 in the predefined range, first and third gammas are adjusted from original γR and γB to γR2 and γB2, where γR2>γR and γB2>γB.

In another embodiment of this application, the predefined range corresponding to the grayscales of the first, the second, and the third average signals in step S102 is: when the grayscale of the second average signal of the zone is in a range of 50 to 0 in the predefined range, and when the grayscale of the first average signal of the zone and the grayscale of the third average signal of the zone are in a range of 20 to 50 in the predefined range, first and third gammas are adjusted from original γR and γB to γR1 and γB1, where γR1<γR and γB1<γB; or when the grayscale of the first average signal of the zone and the grayscale of the third average signal of the zone are in a range of 0 to 20 in the predefined range, first and third gammas are adjusted from original γR and γB to γR2 and γB2, where γR2>γR and γB2>γB.

In the foregoing embodiments, after adjustment, the first and the third gammas decrease, and luminance corresponding to the first and the third grayscales increases, and luminance increase calculation formulas are:

$L'R(g)=LR(255)*(g/255)^{\gamma R1}$, which is approximate to $LR(g)=LR(255)*(g/255)^{\gamma R}$; and $L'B(g)=LB(255)*(g/255)^{\gamma B1}$, which is approximate to $LR(g)=LR(255)*(g/255)^{\gamma R}$.

An increase in the first and the third gammas causes a decrease in luminance corresponding to the first and the third grayscales, and luminance decrease calculation formulas are:

$L''R(g)=LR(255)*(g/255)^{\gamma R2}$ which is approximate to $LR(g)=LR(255)*(g/255)^{\gamma R}$; and $L''B(g)=LB(255)*(g/255)^{\gamma B2}$ which is approximate to $LB(g)=LB(255)*(g/255)^{\gamma B}$.

Grayscale g represents any grayscale.

Referring to FIG. 5, this application further provides another embodiment to describe a drive method of a display apparatus. When direct type LED backlight is used in this application, the backlight is divided into columns (N) and rows (M) zones like a display. Each zone (n,m) has independent RGB LED light sources. Initial RGB LED luminance signals in the zone (n,m) are An,m_R, An,m_G, and An,m_B. To compensate for luminance increases, that is, $L'R(g)=LR(255)*(g/255)^{\gamma R1}$ which is approximate to $LR(g)=LR(255)*(g/255)^{\gamma R}$ and $L'B(g)=LB(255)*(g/255)^{\gamma B1}$ which is approximate to $LB(g)=LB(255)*(g/255)^{\gamma B}$, caused by decreasing the first and the third gammas from original γR and γB to γR1 and γB1, where γR1<γR and γB1<γB, the first and the third LED luminance signals in the zone are decreased to A'n,m_R and A'n,m_B.

A luminance adjustment ratio calculation formula for red (R) is:

$$A'n,m_R/An,m_R=LR(Ave_Rn,m)/L'R(Ave_Rn,m)=LR(255)*(Ave_Rn,m/255)^{\gamma R}/LR(255)*(Ave_Rn,m/255)^{\gamma R1}.$$

A luminance adjustment ratio calculation formula for blue (B) is:

$$A'n,m_B/An,m_B=LB(Ave_Bn,m)/L'B(Ave_Bn,m)=LB(255)*(Ave_Bn,m/255)^{\gamma B}/LB(255)*(Ave_Bn,m/255)^{\gamma B1}.$$

To compensate for luminance decreases, that is, $L''R(g)=LR(255)*(g/255)\gamma R2$ which is approximate to $LR(g)=LR(255)*(g/255)\gamma R$ and $L''B(g)=LB(255)*(g/255)^{\gamma B2}$ which is approximate to $LB(g)=LB(255)*(g/255)^{\gamma B}$, caused by increasing the first and the third gammas from original γR and γB to γR2 and γB2, where γR2>γR and γB2>γB, the first and the third LED luminance signals of the zone are increased to A"n,m_R and A"n,m_B.

A luminance adjustment ratio calculation formula for red (R) is:

$$A''n,m_R/An,m_R=LR(Ave_Rn,m)/L''R(Ave_Rn,m)=LR(255)*(Ave_Rn,m/255)^{\gamma R}/LR(255)*(Ave_Rn,m/255)^{\gamma R2}.$$

A luminance adjustment ratio calculation formula for blue (B) is:

$$A''n,m_B/An,m_B=LB(Ave_Bn,m)/L''B(Ave_Bn,m)=LB(255)*(Ave_Bn,m/255)^{\gamma B}/LB(255)*(Ave_Bn,m/255)^{\gamma B2}.$$

In this embodiment, by means of compensation for the first and third LED luminance signals, a color viewed in a front viewing angle can be maintained the same as an original color, and performance of the original color is not affected by adjustment of first and third gamma signals.

Referring to FIG. 7, this application further provides a display apparatus, including a display panel 710 and the drive apparatus 500 of the display apparatus in the foregoing embodiment.

According to the drive method and apparatus of the display apparatus in this application, a grayscale drive method for improving a color cast of a second hue in a large viewing angle is used. That is, average signals of subpixel units in a zone are calculated, to obtain a first average signal of the zone, a second average signal of the zone, and a third average signal of the zone; first and third gamma adjustments are separately performed according to a predefined range corresponding to grayscales of the first, the second, and the third average signals; and the first and the third input gamma signals are increased. In this way, luminance ratios of first and third large viewing angles to a second large viewing angle, thereby improving brightness of a second hue in a large viewing angle. In addition, by means of compensation for first and third light source luminance signals, a color viewed in a front viewing angle can be maintained the same as an original color, and performance of the original color is not affected by adjustment of first and third gamma signals. Color brightness of the second hue in a large viewing angle can be improved while performance of an original color signal can be maintained.

Phrases such as "in an embodiment of this application" and "in various embodiments" are repeatedly used. The wordings usually refer to different embodiments, but they may also refer to a same embodiment. Words such as "comprise", "have", "include" are synonyms, unless other meanings are indicated in the context.

The foregoing descriptions are merely embodiments of this application, and are not intended to limit this application in any form. Although this application has been disclosed above through the embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A drive method of a display apparatus, comprising the following steps:

calculating average signals of subpixel units in a zone, to obtain a first average signal of the zone, a second average signal of the zone, and a third average signal of the zone;

separately adjusting first and third gamma according to a predefined range corresponding to grayscales of the first, the second, and the third average signals; and adjusting luminance of corresponding first and third light sources according to the adjusted first and third gammas (γ), wherein for the grayscales of the average signals, the grayscale of the second average signal of the zone is a first grayscale value in the predefined range; and when the grayscale of the first average signal of the zone and the grayscale of the third average signal of the zone are a second grayscale value in the predefined range, first and third gammas (γ) are adjusted from original γR and γB to γR1 and γB1, wherein γR1<γR and γB1<γB, γ represents gamma, R represents red color and B represents blue color; or when the grayscale of the first average signal of the zone and the grayscale of the third average signal of the zone are a third grayscale value in the predefined range, first and third gammas (γ) are adjusted from original γR and γB to γR2 and γB2, wherein γR2>γR and γB2>γB, γ represents gamma, R represents red color and B represents blue color.

2. The drive method of a display apparatus according to claim 1, wherein the first grayscale value, the second grayscale value, and the third grayscale value in the predefined range are selected from the following groups:

a first group: when the first grayscale value is in a range of 255 to 200, the second grayscale value is in a range of 80 to 200, and the third grayscale value is in a range of 0 to 50;

a second group: when the first grayscale value is in a range of 200 to 150, the second grayscale value is in a range of 80 to 200, and the third grayscale value is in a range of 0 to 80;

a third group: when the first grayscale value is in a range of 150 to 100, the second grayscale value is in a range of 60 to 150, and the third grayscale value is in a range of 0 to 60;

a fourth group: when the first grayscale value is in a range of 100 to 50, the second grayscale value is in a range of 40 to 100, and the third grayscale value is in a range of 0 to 40; and a fifth group: when the first grayscale value is in a range of 50 to 0, the second grayscale value is in a range of 20 to 50, and the third grayscale value is in a range of 0 to 20.

3. The drive method of a display apparatus according to claim 1, wherein when the grayscale of the first average signal of the zone and the grayscale of the third average signal of the zone are the second grayscale value in the predefined range, the first and the third gammas are adjusted, so that luminance corresponding to the grayscales of the first and the third average signals increases, and luminance increase calculation formulas are:

$$L'R(g)=LR(255)*(g/255)^{\gamma R1}; \text{ and}$$

$$L'B(g)=LB(255)*(g/255)^{\gamma B1}, \text{ wherein}$$

g represents grayscale value.

4. The drive method of a display apparatus according to claim 1, wherein when the grayscale of the first average signal of the zone and the grayscale of the third average signal of the zone are the third grayscale value in the predefined range, the first and the third gammas are adjusted, so that luminance corresponding to the grayscales of the first and the third average signals decreases, and luminance decrease calculation formulas are:

$$L''R(g)=LR(255)*(g/255)^{\gamma R2}; \text{ and}$$

$$L''B(g)=LB(255)*(g/255)^{\gamma B2}, \text{ wherein}$$

g represents grayscale value.

5. The drive method of a display apparatus according to claim 1, wherein a calculation formula for the adjusting luminance corresponding to a first light source is:

$$A'n,m_R/An,m_R=LR(Ave_Rn,m)/L'R(Ave_Rn,m)=LR(255)*(Ave_Rn,m/255)\gamma R/LR(255)*(Ave_Rn,m/255)\gamma R1; \text{ and}$$

$$A''n,m_R/An,m_R=LR(Ave_Rn,m)/L''R(Ave_Rn,m)=LR(255)*(Ave_Rn,m/255)\gamma R/LR(255)*(Ave_Rn,m/255)\gamma R2, \text{ wherein}$$

A'n,m_R and A"n,m_R are an adjusted first light source luminance signal, An,m_R is an initial first light source luminance signal, Ave_Rn,m is a calculated average signal of all first subpixel units in the zone, and n and m are a column and a row in which the zone is located.

6. The drive method of a display apparatus according to claim 1, wherein a calculation formula for the adjusting luminance corresponding to a third light source is:

$$A'n,m_B/An,m_B=LB(Ave_Bn,m)/L'B(Ave_Bn,m)=LB(255)*(Ave_Bn,m/255)\gamma B/LB(255)*(Ave_Bn,m/255)\gamma B1; \text{ and}$$

$$A''n,m_B/An,m_B=LB(Ave_Bn,m)/LB(Ave_Bn,m)=LB(255)*(Ave_Bn,m/255)\gamma B/LB(255)*(Ave_Bn,m/255)\gamma B2, \text{ wherein}$$

A'n,m_B and A"n,m_B are an adjusted third light source luminance signal, An,m_B is an initial third light source luminance signal, Ave_Bn,m is a calculated average signal of all third subpixel units in the zone, and n and m are a column and a row in which the zone is located.

* * * * *